US009110395B2

(12) United States Patent
Tani et al.

(10) Patent No.: US 9,110,395 B2
(45) Date of Patent: Aug. 18, 2015

(54) IMAGE FORMING APPARATUS AND CARTRIDGE

(75) Inventors: Sadaaki Tani, Numazu (JP); Akinobu Hirayama, Mishima (JP); Takateru Ohkubo, Susono (JP); Takahito Ueno, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 39 days.

(21) Appl. No.: 13/615,132

(22) Filed: Sep. 13, 2012

(65) Prior Publication Data

US 2013/0084085 A1 Apr. 4, 2013

(30) Foreign Application Priority Data

Sep. 29, 2011 (JP) ..... 2011-215335

(51) Int. Cl.
*G03G 15/01* (2006.01)
*G03G 21/18* (2006.01)

(52) U.S. Cl.
CPC ..... *G03G 15/0189* (2013.01); *G03G 21/185* (2013.01); *G03G 21/1896* (2013.01); *G03G 2215/0132* (2013.01)

(58) Field of Classification Search
CPC ..... G03G 15/0189; G03G 21/1896; G03G 21/185; G03G 2215/0132
USPC ..... 399/9, 12, 13, 25; 347/138, 152
See application file for complete search history.

(56) References Cited

U.S. PATENT DOCUMENTS

| | | | | |
|---|---|---|---|---|
| 6,097,405 | A * | 8/2000 | Lo et al. | 347/6 |
| 2007/0264032 | A1* | 11/2007 | Harumoto | 399/12 |
| 2008/0050148 | A1 | 2/2008 | Zensai | |
| 2009/0060570 | A1* | 3/2009 | Mizuno et al. | 399/114 |
| 2009/0167809 | A1* | 7/2009 | Kondo | 347/19 |

FOREIGN PATENT DOCUMENTS

| | | | |
|---|---|---|---|
| CN | 1384405 | A | 12/2002 |
| CN | 101071282 | A | 11/2007 |
| JP | 1213679 | A | 8/1989 |
| JP | H04-042258 | A | 2/1992 |
| JP | 2000-194247 | A | 7/2000 |
| JP | 2005-345939 | A | 12/2005 |
| JP | 2006-171622 | A | 6/2006 |
| JP | 2008-216392 | A | 9/2008 |
| JP | 2010-014890 | A | 1/2010 |
| JP | 2010-032594 | A | 2/2010 |

* cited by examiner

*Primary Examiner* — David Gray
*Assistant Examiner* — Sevan A Aydin
(74) *Attorney, Agent, or Firm* — Canon USA Inc. IP Division

(57) ABSTRACT

An image forming apparatus includes a moving member equipped with a pressed portion and a detected portion, and in which the detected portion is configured to move to a predetermined position above the pressed portion by the pressed portion being pressed by the cartridge when the cartridge is attached to the image forming apparatus main body, and a detection device configured to detect whether the cartridge is attached by detection light passing the predetermined position.

26 Claims, 13 Drawing Sheets

IMAGE FORMING APPARATUS AND CARTRIDGE

BACKGROUND OF THE INVENTION

1. Field of the Invention

The present invention relates to a process cartridge and a developer replenishment cartridge that are attachable/detachable to/from an electrophotographic image forming apparatus main body, and to an electrophotographic image forming apparatus employing these cartridges.

An electrophotographic image forming apparatus (hereinafter referred to as an "image forming apparatus") is an apparatus configured to form an image on a recording medium by using an electrophotographic image forming process. Examples of an electrophotographic image forming apparatus include an electrophotographic copying machine, an electrophotographic printer (such as a light-emitting diode (LED) printer and a laser beam printer), an electrophotographic facsimile apparatus, and an electrophotographic word processor.

A recording medium is an object on which an image is formed, for example, a recording sheet and an overhead projector (OHP) sheet.

2. Description of the Related Art

Conventionally, an image forming apparatus has employed a process cartridge system in which an electrophotogrpahic photosensitive member and a process unit acting thereon are integrated into a cartridge, which is attachable/detachable to/from an image forming apparatus main body. The process cartridge system helps to achieve an improvement in terms of operability since it enables users to perform maintenance on the apparatus by themselves.

A process cartridge is formed by a cleaning unit and a development unit. The cleaning unit includes an image bearing member as an electrophotographic photosensitive member, and a cleaning member configured to clean the surface of the image bearing member. The development unit includes a development roller for supplying developer to the image bearing member, and a developer storage unit storing developer.

On the other hand, a developer replenishment system is known as an example of the process cartridge system. In this system, a developer replenishment opening of a developer replenishment cartridge and a developer reception opening of a process cartridge are detachably connected to each other, with developer being supplied from the developer replenishment cartridge to the process cartridge (See FIG. 4 on page 14 of Japanese Patent Application Laid-Open No. 2010-014890).

On the other hand, there has been proposed a system in which there are provided a light transmission type detection sensor for detecting the attachment condition of a process cartridge, and a sensor lever configured to act thereon, and the sensor lever is moved in conjunction with the attachment of the process cartridge to thereby detect the attachment condition of the process cartridge (See FIG. 2 on page 10 of Japanese Patent Application Laid-Open No. 2005-345939).

SUMMARY OF THE INVENTION

The present invention is directed to an image forming apparatus having a detection device configured to detect by detection light whether a cartridge storing developer has been attached to an image forming apparatus main body, thereby reducing erroneous detection by the detection device.

According to an aspect of the present invention, an image forming apparatus includes: a development unit configured to develop an electrostatic image formed on an electrophotographic photosensitive member; a cartridge configured to replenish the development unit with developer and detachable with respect to an image forming apparatus main body; a moving member equipped with a pressed portion and a detected portion, with the detected portion being configured to move to a predetermined position above the pressed portion through pressing of the pressed portion by the cartridge when the cartridge is attached to the image forming apparatus main body; and a detection device configured to detect whether the cartridge has been attached by detection light passing the predetermined position.

According to another aspect of the present invention, a cartridge for replenishing a development unit configured to develop an electrostatic image formed on an electrophotographic photosensitive member with developer, includes: a pressing portion provided so as to be detachable with respect to an image forming apparatus main body including a moving member equipped with a pressed portion and a detected portion, with the detected portion being configured to move to a predetermined position above the pressed portion through pressing of the pressed portion by the cartridge when the cartridge is attached to the image forming apparatus main body, and a detection device configured to detect whether the cartridge has been attached by detection light passing the predetermined position, wherein the pressing portion is configured to move the pressed portion to the predetermined position above the pressed portion through pressing of the pressed portion when the cartridge is attached to the image forming apparatus main body.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Hereinbelow, a color image forming apparatus employing a developer replenishment cartridge and a process cartridge according to an exemplary embodiment of the present invention will be described with reference to the drawings.

Figure 1:
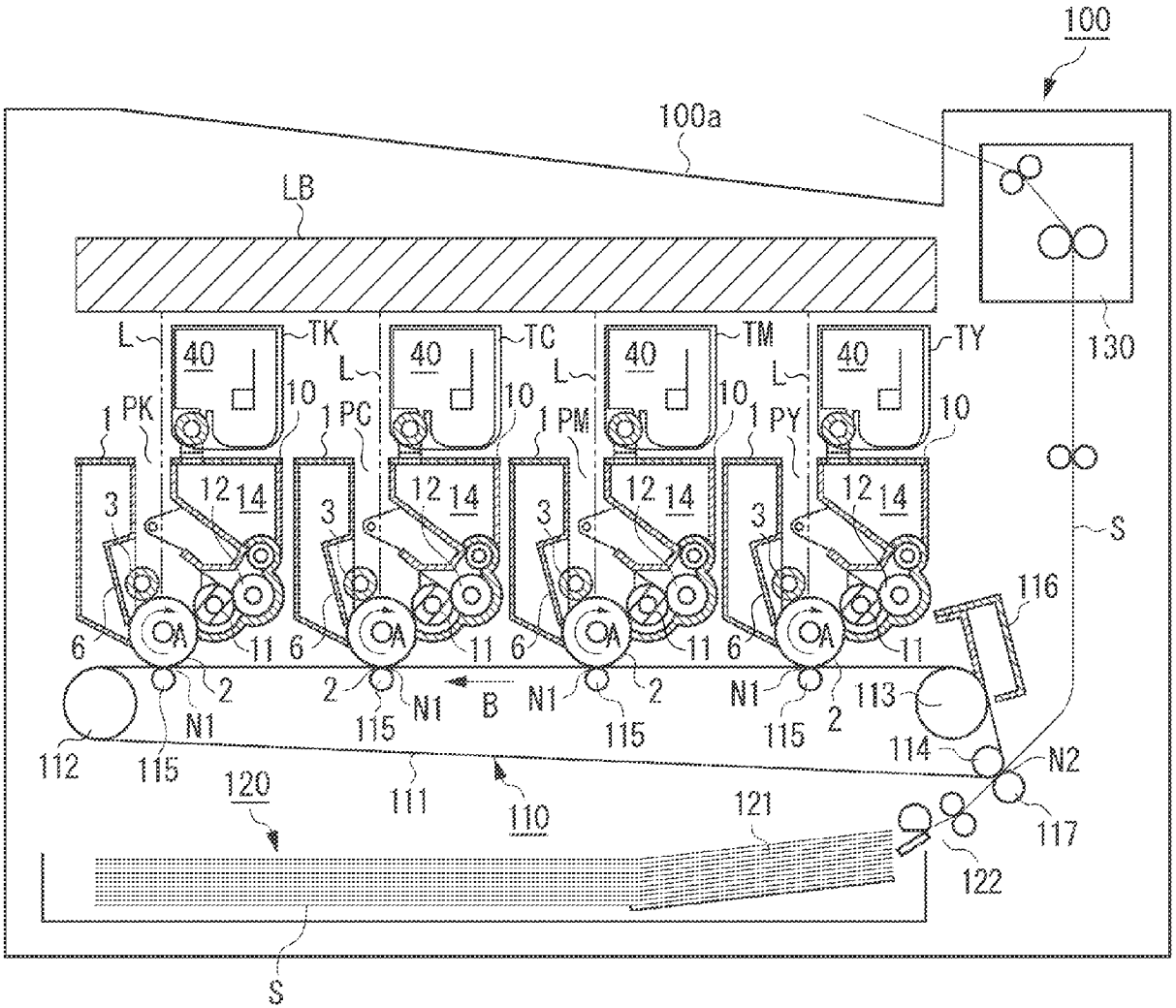
FIG. 1 is a schematic sectional view of a color electrophotographic image forming apparatus according to an exemplary embodiment of the present invention.
Figure 2:
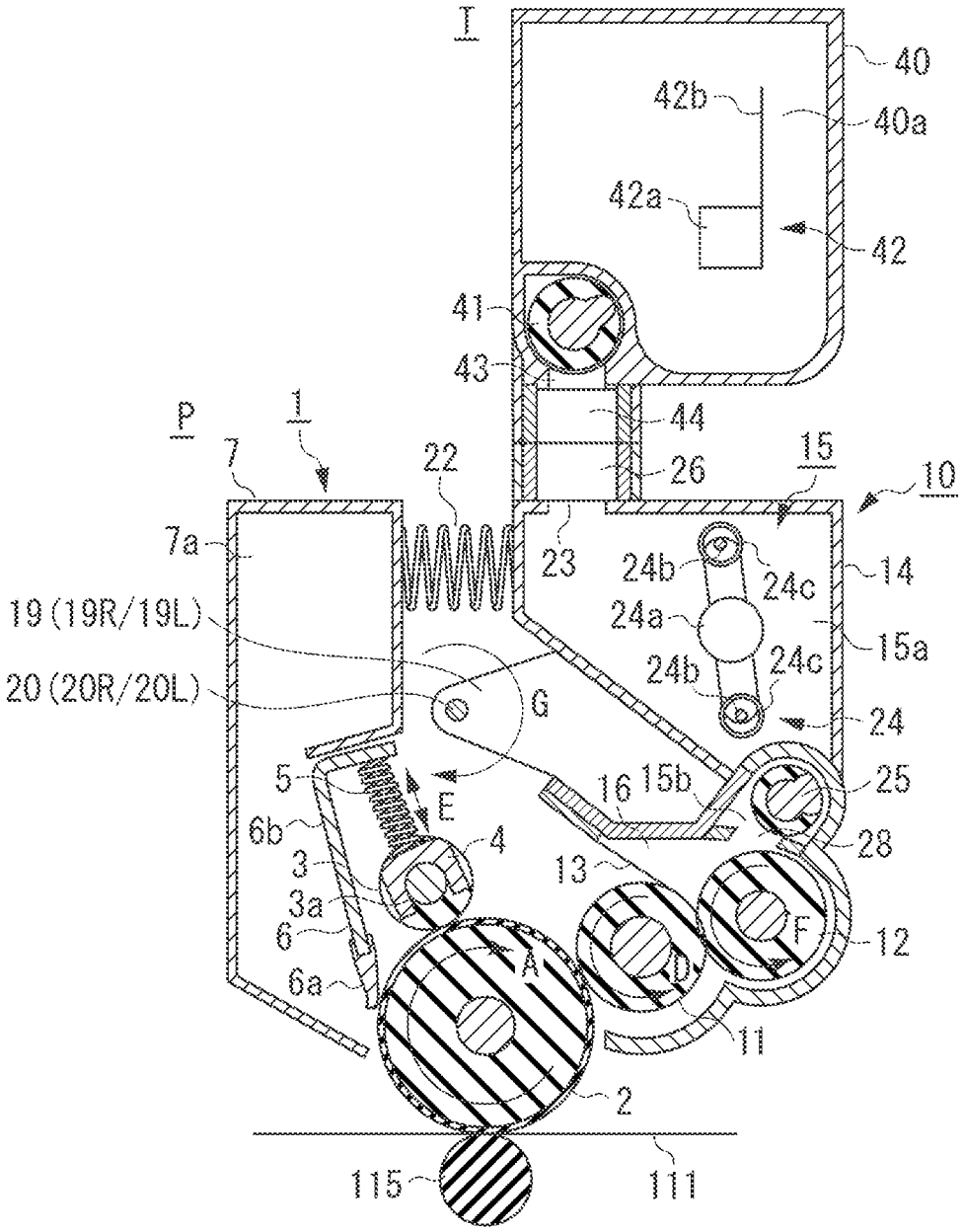
FIG. 2 is a main portion sectional view of a process cartridge and a developer replenishment cartridge according to an exemplary embodiment of the present invention.

First, an overall construction of the image forming apparatus will be described with reference to FIGS. 1 and 2. FIG. 1 is a schematic sectional view of a color electrophotographic image forming apparatus. FIG. 2 is a main portion sectional view of a process cartridge and a developer replenishment cartridge.

An image forming apparatus 100 illustrated in FIG. 1 is a full four-color laser printer employing the electrophotographic process. The image forming apparatus performs color image formation on a recording medium S. The image forming apparatus 100 is a process cartridge type image forming apparatus employing a developer replenishment system. In this system, a process cartridge P and a developer replenishment cartridge T are detachably attached to the main body of the image forming apparatus 100 to form a color image on the recording medium S.

In the following description, the image forming apparatus main body (hereinafter referred to as the apparatus main body) refers to the portion of the image forming apparatus excluding the process cartridge P and the developer replenishment cartridge T.

In the apparatus main body 100, first through fourth process cartridges P (PY, PM, PC, and PK) and first through fourth developer replenishment cartridges T (TY, TM, TC, and TK) are horizontally arranged side by side. The process cartridges P and the developer replenishment cartridges T are of a similar electrophotographic process mechanism and differ from each other in developer color and in amount of developer charged therein.

A rotational drive force is transmitted from the apparatus main body 100 to the process cartridges P and the developer replenishment cartridges T. Further, a bias (charging bias, development bias, etc.) is supplied from the apparatus main body 100 to the process cartridges P. The process cartridges P and the developer replenishment cartridges T are independently attachable/detachable to/from the apparatus main body 100.

As illustrated in FIG. 2, each process cartridge P according to the present exemplary embodiment is composed of a cleaning unit 1 and a development unit 10. The cleaning unit 1 is equipped with an electrophotographic photosensitive drum 2 (hereinafter referred to as the photosensitive drum) as an image bearing member, a charging roller 3 acting on this photosensitive drum 2, and a cleaning member 6.

The development unit 10 has a development means for developing an electrostatic latent image (electrostatic image) on the photosensitive drum 2. The cleaning unit 1 and the development unit 10 are swingably connected to each other.

The first process cartridge PY stores yellow (Y) developer inside a developer storage unit 15, and is configured to form a yellow developer image on the surface of the photosensitive drum 2. Similarly, the second process cartridge PM stores magenta (M) developer, the third process cartridge PC stores cyan (C) developer, and the fourth process cartridge PK stores black (K) developer.

On the other hand, the first developer replenishment cartridge TY stores yellow (Y) developer in a replenishment frame body 40, and supplies yellow developer to the process cartridge PY storing developer of the same color. Similarly, the second developer replenishment cartridge TM stores magenta (M) developer, and supplies magenta developer to the process cartridge PM storing developer of the same color.

Similarly, the third developer replenishment cartridge TC stores cyan (C) developer, and supplies cyan developer to the process cartridge PC storing developer of the same color. Similarly, the fourth developer replenishment cartridge TK stores black (K) developer, and supplies black developer to the process cartridge PK storing developer of the same color.

As illustrated in FIG. 2, in the lower portion of a replenishment frame body 40 of the developer replenishment cartridge T, there is provided a developer replenishment opening 43 for replenishing the process cartridge with developer. The development storage unit 15 of the process cartridge P is provided with a developer reception opening 23 corresponding to the developer replenishment opening 43.

When the process cartridge P and the developer replenishment cartridge T are attached to the apparatus main body 100, the developer replenishment opening 43 and the developer reception opening 23 are communicated with each other, and developer is supplied from the developer replenishment cartridge T to the process cartridge P.

The process cartridge P and the developer replenishment cartridge T will be described in detail below.

As illustrated in FIG. 1, a laser scanner unit LB as an exposure unit is arranged above the process cartridges P (PY, PM, PC, and PK). The laser scanner unit LB outputs laser light L corresponding to the image information. The laser light L is used for scanning exposure of the surfaces of the photosensitive drums 2.

Under the process cartridges P (PY, PM, PC, and PK), there is arranged an intermediate transfer belt unit 110 as a primary transfer member. The intermediate transfer belt unit 110 includes a flexible endless transfer belt 111, a driving roller 112 configured to rotate the transfer belt 111 in stretched manner, a driven roller 113, and a secondary transfer opposing roller 114.

The respective photosensitive drums 2 of the process cartridges Pare in contact with the transfer belt 111. Contact portions N1 between the photosensitive drums 2 and the transfer belt 111 constitute primary transfer portions. On the inner side of the transfer belt 111, there are arranged primary transfer rollers 115 so as to be opposed to the photosensitive drums 2.

At a position opposing the secondary transfer opposing roller 114, there is arranged a secondary transfer roller 117 as the secondary transfer member. The contact portion N2 between of the transfer belt 111 and the secondary transfer roller 117 constitutes a secondary transfer portion.

A feeding unit 120 is arranged below the intermediate transfer belt unit 110. The feeding unit 120 includes a feeding tray 121 storing the recording media S, and feeding rollers 122.

A fixing unit 130 is arranged in the upper portion in the apparatus main body 100. The upper surface of the apparatus main body 100 constitutes a discharge tray 100*a*.

Next, the operation of forming a full color image will be described with reference to FIG. 1. FIG. 1 is a schematic sectional view illustrating a color electrophotographic image forming apparatus.

The full color image forming operation is as follows. The respective photosensitive drums 2 of the first through fourth process cartridges P (PY, PM, PC, and PK) are rotated in the direction of the arrow A at a predetermined speed. The transfer belt 111 is also rotated in the direction of the arrow B (in the forward direction with respect to the rotation of the photosensitive drums). At this time, the speed of the transfer belt 111 corresponds to the speed of the photosensitive drums 2. At the same time, the laser scanner unit LB is driven.

In synchronization with the driving of the laser scanner unit LB, the respective charging rollers 3 of the process cartridges P uniformly charge the surfaces of the photosensitive drums 2 to a predetermined polarity and potential. The laser scanner unit LB performs scanning exposure on the surfaces of the photosensitive drums 2 with laser light L corresponding to image signals of the different colors. As a result, electrostatic latent images corresponding to the image signals of the corresponding colors are formed on the respective surfaces of the photosensitive drums 2. The electrostatic latent images formed are developed by the development rollers 11.

Through the above image forming operation, a yellow developer image is formed on the photosensitive drum 2 of the first process cartridge PY. Then, the yellow developer image is primary-transferred onto the transfer belt 111. Similarly, the developer images of the second process cartridge PM, the third process cartridge PC, and the fourth process cartridge PK are superposed one upon the other on the transfer belt 111, whereby an unfixed full four-color developer image is formed.

On the other hand, the recording medium S stored in the feeding tray 121 is fed at a predetermined control timing. The full four-color developer image on the transfer belt 111 is collectively transferred onto the surface of the recording medium S that is introduced into the secondary transfer portion N2.

The recording medium S is separated from the surface of the transfer belt 111 and is introduced into a fixing unit 130. Then, it is heated and pressurized at a fixing nip portion. As a result, the developer image is fixed to the recording medium S. After this, the recording medium S that has been fixed is conveyed to a discharge tray 100*a*, whereby the full-color image forming operation is completed.

Figure 3:
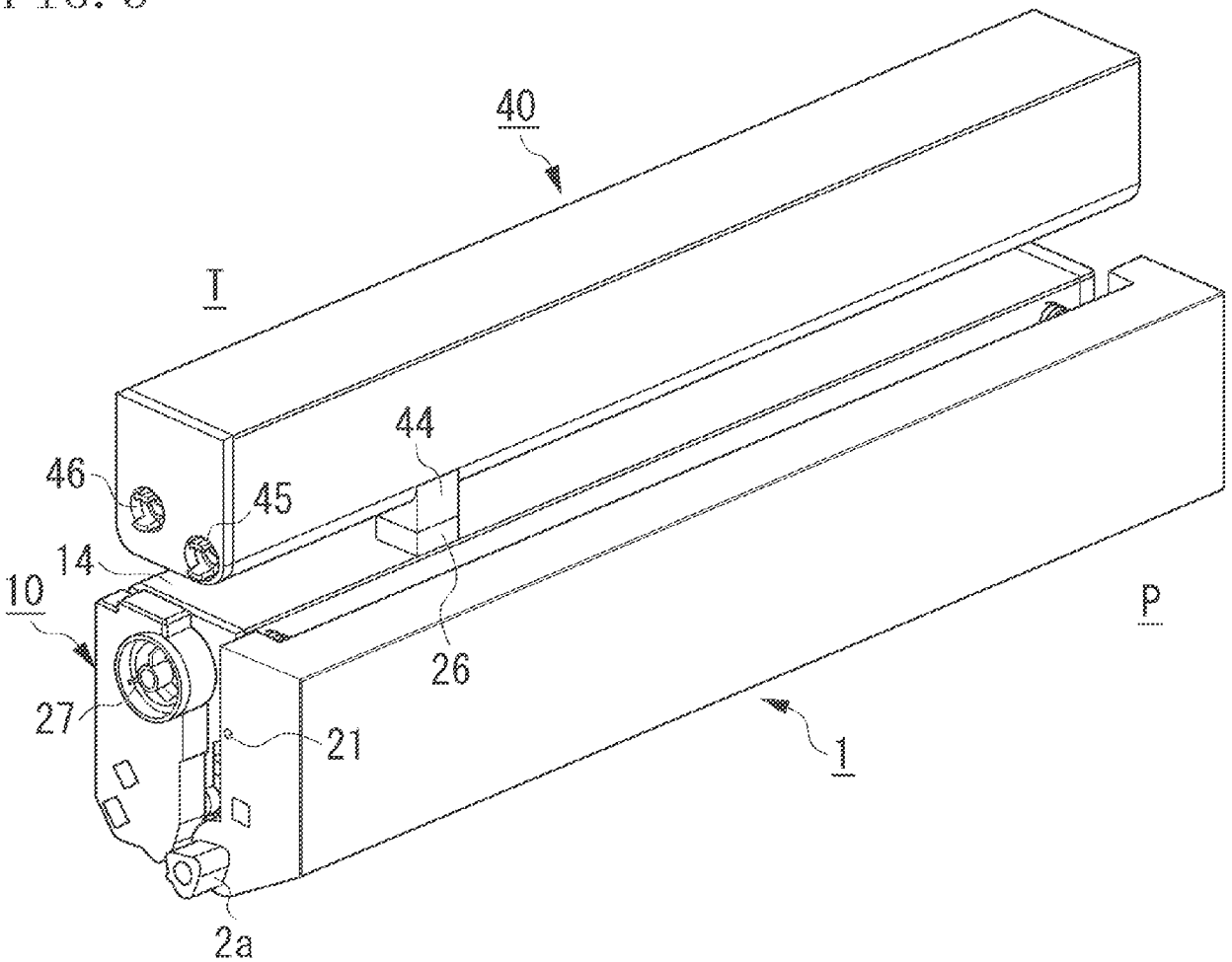
FIG. 3 is an overall view of the process cartridge and the developer replenishment cartridge in an image forming apparatus according to an exemplary embodiment of the present invention.
Figure 4:
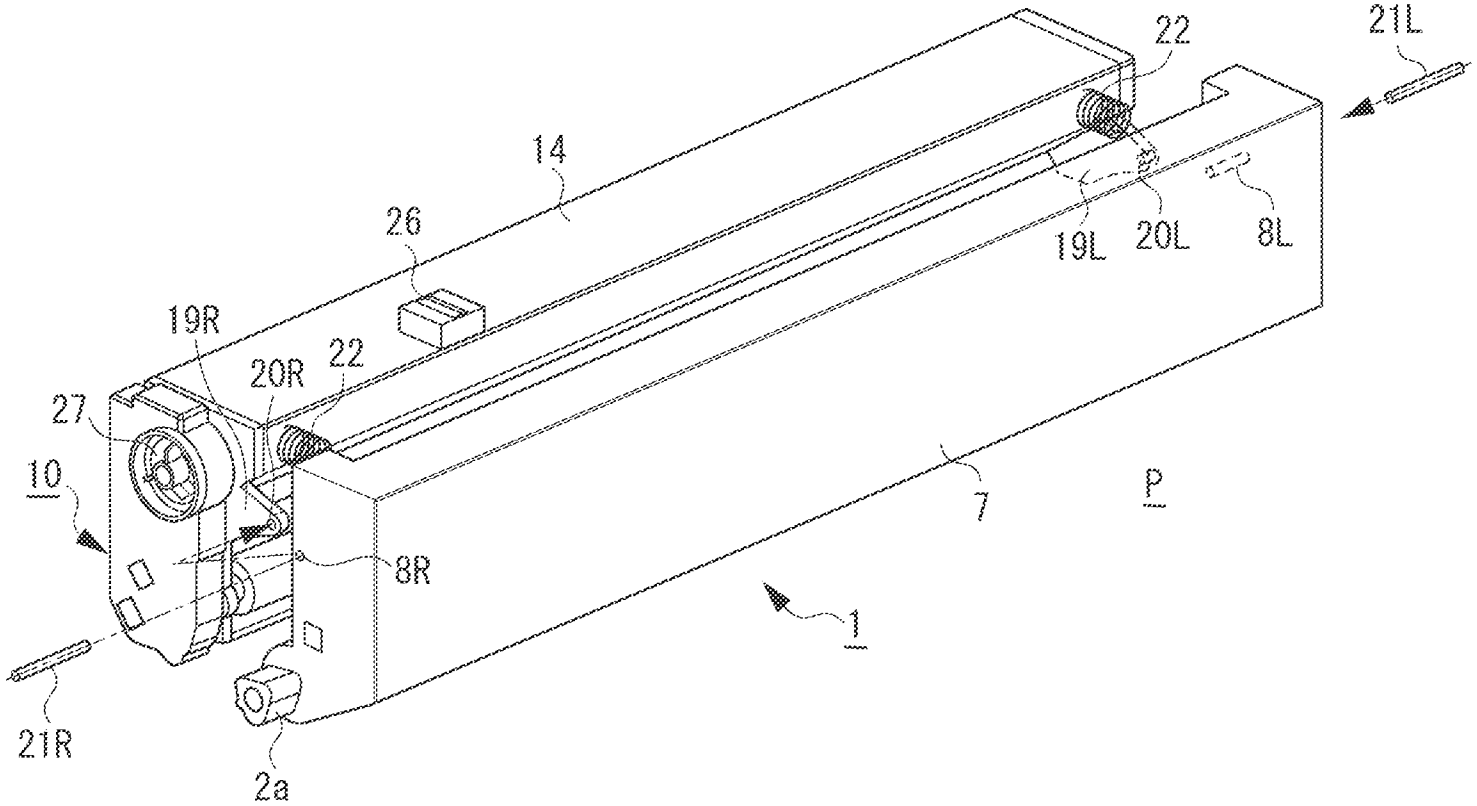
FIG. 4 is an overall view of the process cartridge according to an exemplary embodiment of the present invention.

Next, the overall configuration of the process cartridge P will be described with reference to FIGS. 2, 3, and 4. FIG. 2 is a main portion sectional view of the process cartridge and the developer replenishment cartridge. FIG. 3 is an overall diagram illustrating the developer replenishment cartridge T and the process cartridge P in the apparatus main body. FIG. 4 is an overall diagram of the process cartridge.

As illustrated in FIG. 2, the process cartridge P (PY, PM, PC, and PK) is formed by a cleaning unit 1 and a development unit 10.

First, the cleaning unit 1 will be described. The cleaning unit 1 includes a cleaning frame body 7, a photosensitive drum 2, a charging roller 3, and a cleaning member 6.

The photosensitive drum 2 is rotatably supported by the cleaning frame body 7. As illustrated in FIG. 3, at one end of the photosensitive drum 2, there is provided a drum drive coupling 2*a*. The photosensitive drum 2 and the drive coupling 2*a* are formed integrally. The drum drive coupling 2*a* is engaged with a coupling (not illustrated) of the apparatus main body 100.

The drive force of a drive motor (not illustrated) of the apparatus main body 100 is transmitted to the drum drive coupling 2*a*, whereby the photosensitive drum 2 is rotated in the direction of the arrow A of FIG. 2 at a predetermined speed.

The charging roller 3 is driven to be rotated while being in contact with the photosensitive drum 2. As illustrated in FIG. 2, the charging roller 3 is mounted to the cleaning frame body 7 via a charging roller bearing 4.

The charging roller 3 is mounted so as to be movable in the direction of the arrow E along the line connecting the rotation center of the charging roller 3 and the rotation center of the photosensitive drum 2. A rotation shaft 3*a* of the charging roller 3 is rotatably supported by the charging roller bearing 4. The charging roller bearing 4 is urged toward the photosensitive drum 2 by a pressurization member 5.

The cleaning member 6 is composed of an elastic rubber blade 6*a* at the distal end thereof and a support metal plate 6*b*. The distal end of the elastic rubber blade 6*a* is held in contact in a counter direction with respect to the rotational direction of the photosensitive drum 2 (the direction of the arrow A of FIG. 2). The cleaning member 6 removes the developer remaining on the photosensitive drum 2. The developer removed from the peripheral surface of the photosensitive drum 2 by the cleaning member 6 is stored in a removed developer storage unit 7*a*.

Next, the development unit 10 will be described. As illustrated in FIG. 2, the development unit 10 has a development frame body 14 supporting various components in the development unit 10. The development frame body 14 is divided into a development portion 16 and a developer storage unit 15.

The development portion 16 is provided with a development roller 11, a developer supply roller (hereinafter referred to as the "supply roller") 12, and a development blade 13. The development roller 11 rotates in the direction of the arrow D while being in contact with the photosensitive drum 2.

The supply roller 12 rotates in the direction of the arrow F while being in contact with the development roller 11. The supply roller 12 serves two functions: first, it supplies developer onto the development roller 11; second, it scrapes off the portion of the developer remaining on the development roller 11 without being used for development. The development blade 13 is held in contact with the peripheral surface of the development roller 11, thereby regulating the developer layer thickness on the development roller 11.

On the other hand, the developer storage unit 15 stores the developer supplied from the developer replenishment cartridge T. The developer storage unit 15 will be described in detail below.

Next, the connection between the cleaning unit 1 and the development unit 10 will be described. As illustrated in FIG. 4, the cleaning frame body 7 has cleaning connection holes (8R and 8L).

Figure 5:
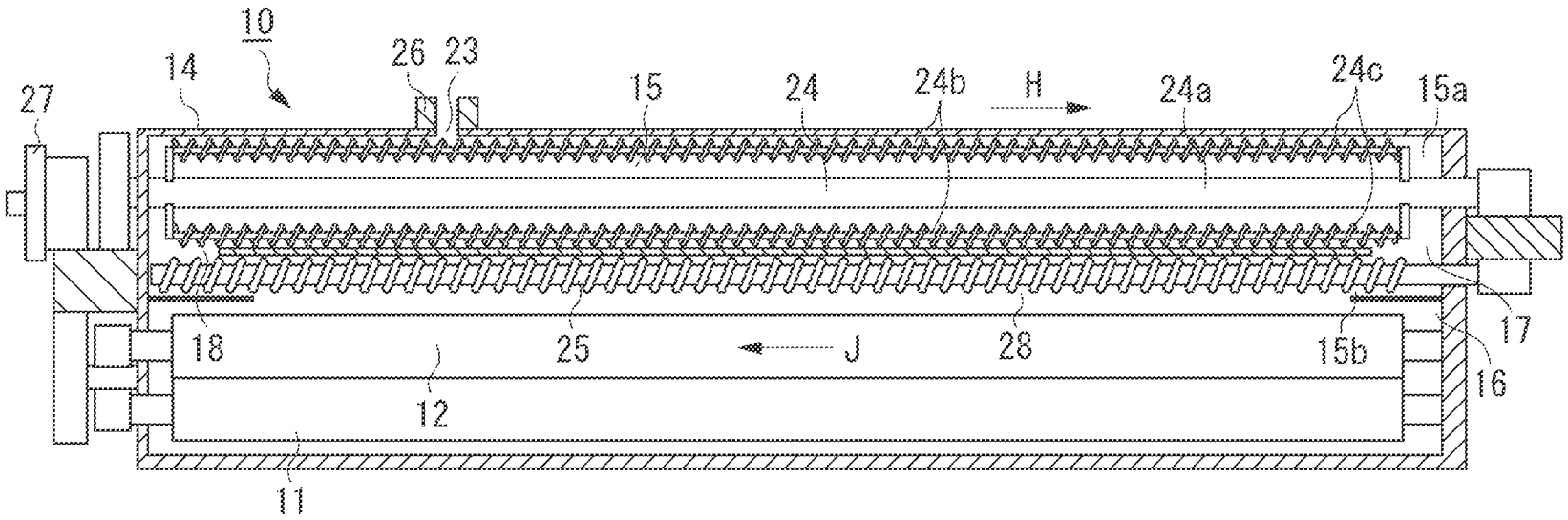
FIG. 5 is a sectional view of a development unit according to an exemplary embodiment of the present invention.

As illustrated in FIGS. 2 and 5, the development frame body 14 is provided with development side plates 19 (19R and 19L) at both longitudinal ends thereof. The development side plates 19 (19R and 19L) have development connection holes 20 (20R and 20L). As illustrated in FIG. 4, the cleaning connection holes 8 (8R and 8R) and the development connection holes (20R and 20L) are swigably connected together by being fit-engaged with connection shafts 21 (21R and 21L). As a result, the cleaning unit 1 and the development unit 10 are connected to each other.

As illustrated in FIGS. 2 and 5, a pressurization spring 22 is arranged between the cleaning unit 1 and the development unit 10. Due to the urging force of the pressurization spring 22, the development unit 10 is provided with rotational moment in the direction of the arrow G around the development connection holes 20. As a result, the development roller 11 is brought into contact with the photosensitive drum 2.

In the present exemplary embodiment, the development roller 11 is arranged so as to be in contact with the photosensitive drum 2, it is also possible for the development roller to be arranged at a predetermined interval from the photosensitive drum.

Next, the configuration of the developer storage unit 15 will be described with reference to FIG. 5. FIG. 5 is a sectional view illustrating the configuration of the development unit 10.

As illustrated in FIG. 5, the developer storage unit 15 is divided into a first storage unit 15*a* and a second storage unit 15*b*. The first storage unit 15*a* and the second storage unit 15*b* are connected together by a first opening 17 and a second opening 18 provided at both longitudinal ends thereof.

The first storage unit 15*a* is provided with a developer reception opening 23. A developer reception shutter 26 is arranged at an upper portion of the developer reception opening 23. Normally, the developer reception shutter 26 is closed. It is open in the state in which the process cartridge P and the developer replenishment cartridge T are attached to the apparatus main body 100.

The second storage unit 15*b* is connected to the development portion 16 via a development opening 28. The first storage unit 15*a* is provided with a developer stirring member 24. The developer stirring member 24 has two functions: first, it mixes the developer within the developer storage unit 15 with the developer supplied from the developer replenishment cartridge T; second, it conveys the resultant developer mixture in the direction of the arrow H.

The developer stirring member 24 has a stirring sprig 24*c* mounted to a development support shaft 24*b* provided around the developer stirring shaft 24*a*. On the other hand, the second storage unit 15*b* is provided with a developer conveyance member 25. The developer conveyance member 25 is a screw member configured to covey the developer in the direction of the arrow J.

The conveyance of the developer in the development unit 10 will be described. In the first storage unit 15*a*, the developer supplied from the developer replenishment cartridge T is mixed with the developer within the developer storage unit 15 by the developer stirring member 24. The resultant developer mixture is sent to the second storage unit 15*b* via the first opening 17.

In the second storage unit 15*b*, the developer is conveyed from the development opening 28 to the development portion 16 by the developer conveyance member 25. The developer conveyed to the development portion 16 is sent from the supply roller 12 to the development roller 11 to be used for development. The portion of the developer which has not been used for development returns from the development portion 16 to the second storage unit 15*b* again. After this, it is conveyed from the second opening 18 to the first storage unit 15*a*.

Figure 6:
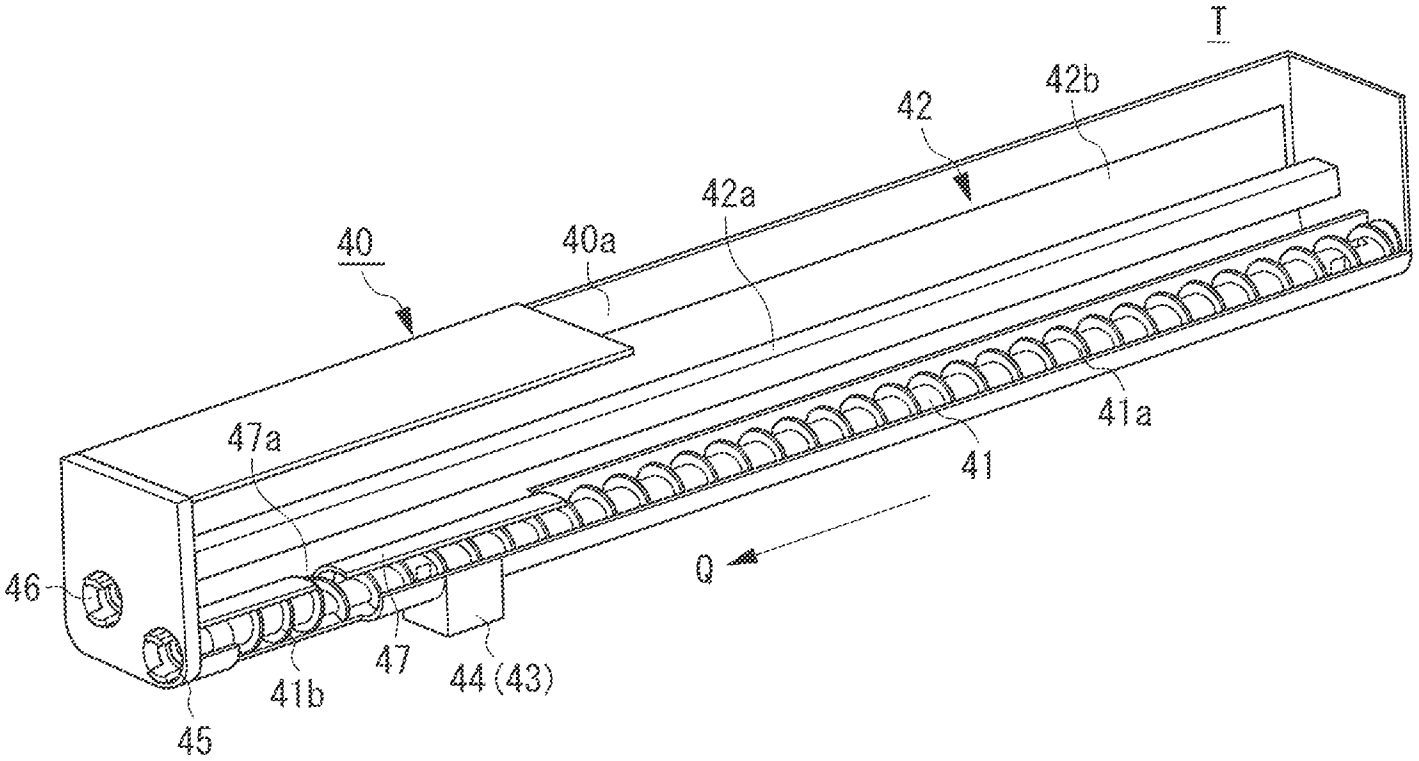
FIG. 6 is a perspective view of the developer replenishment cartridge according to an exemplary embodiment of the present invention.

Next, a configuration of the developer replenishment cartridge T will be described with reference to FIGS. 2 and 6. FIG. 2 is a main portion sectional view of the process cartridge and the developer replenishment cartridge. FIG. 6 is a perspective view illustrating a configuration of the developer replenishment cartridge T.

As illustrated in FIG. 2, the developer replenishment cartridge T has a replenishment frame body 40 for storing developer. The replenishment frame body 40 has a developer replenishment opening 43 for replenishing the process cartridge P with developer.

A developer replenishment shutter 44 is provided under the developer replenishment opening 43. Normally, the developer replenishment shutter 44 is closed. It is open in the state in which the process cartridge P and the developer replenishment cartridge T have been attached to the apparatus main body 100.

A developer conveyance member 41 and a replenishment stirring member 42 are provided in the replenishment frame body 40. The developer conveyance member 41 and the replenishment stirring member 42 are rotatably supported by the replenishment frame body 40.

The replenishment conveyance member 41 conveys the developer in the replenishment frame body 40 toward the developer replenishment opening 43. As illustrated in FIG. 6, the replenishment conveyance member 41 is a screw member having on its surface a spiral fin 41*a* and a return fin 41*b*. The fin 41*a* conveys the developer in the direction of the arrow Q. The return fin 41*b* conveys the developer in a direction reverse to that of the fin 41*a*.

The replenishment stirring member 42 is formed by a replenishment stirring shaft 42*a* and a replenishment stirring sheet 42*b*. The replenishment stirring member 42 has two functions: first, it stirs the developer in the replenishment frame body 40; second, it sends the stirred developer to the replenishment conveyance member 41.

A cover member 47 is provided above the replenishment conveyance member 41. The cover member 47 covers a part in the longitudinal direction of the developer replenishment opening 43 and the replenishment conveyance member 41. The cover member 47 is provided with a return hole 47*a*.

At one longitudinal end of the replenishment conveyance member 41 and of the replenishment stirring member 42, there are respectively provided a replenishment conveyance coupling 45 and a replenishment stirring coupling 46. The replenishment conveyance coupling 45 and the replenishment stirring coupling 46 are engaged with a coupling (not illustrated) of the apparatus main body 100.

The drive force of the drive motor (not illustrated) of the apparatus main body 100 is transmitted to the replenishment conveyance coupling 45 and the replenishment stirring coupling 46, whereby the replenishment conveyance member 41 and the replenishment stirring member 42 are rotated at a predetermined speed.

The conveyance of the developer in the developer replenishment cartridge Twill be described. The developer in the replenishment frame body 40 is stirred by the replenishment stirring member 42, and is sent to the replenishment conveyance member 41. When it has been sent to the cover member 47, the developer sent to the replenishment conveyance member 41 is partially regulated by the cover member 47. As a result, the amount of developer discharged from the developer replenishment opening 43 becomes constant.

The developer conveyed into the cover member 47 is discharged to the process cartridge P through the developer replenishment opening 43. The developer which has not been discharged from the developer replenishment opening 43 is sent through the return hole 47*a* to the replenishment stirring member 42 by the return fin 41*b*, and is stirred again.

Next, a configuration related to the attachment detection of the developer replenishment cartridge, which is a feature of the present invention, will be described in detail.

Figure 7:
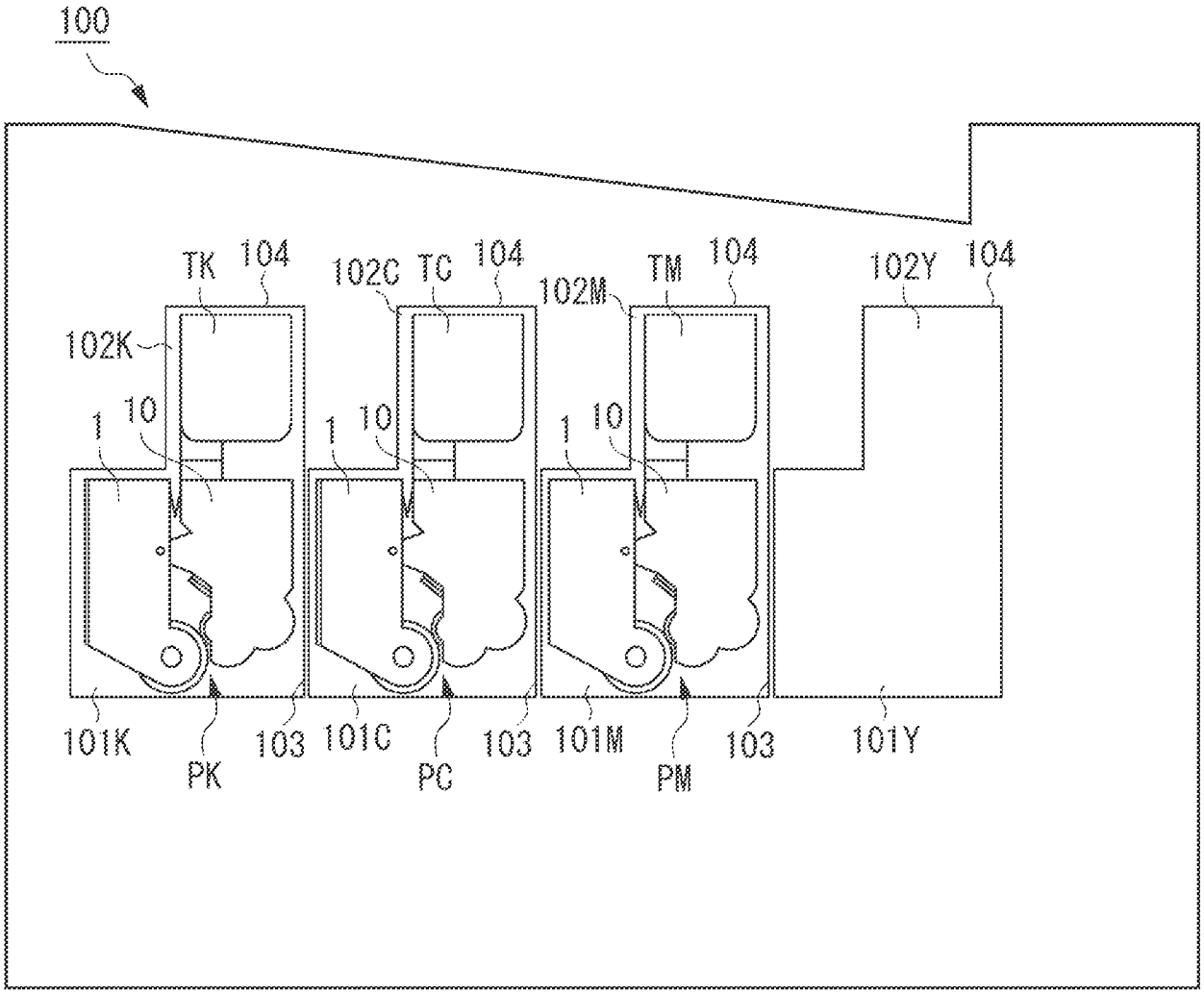
FIG. 7 is a front view of a process cartridge attachment portion and a developer replenishment cartridge attachment portion according to an exemplary embodiment of the present invention.

First, referring to FIGS. 7 and 8, a cartridge attachment portion of the apparatus main body 100 will be described. FIG. 7 is a front view of a process cartridge attachment portion 101 and a developer replenishment cartridge attachment portion 102 of the apparatus main body 100.

Figure 8:
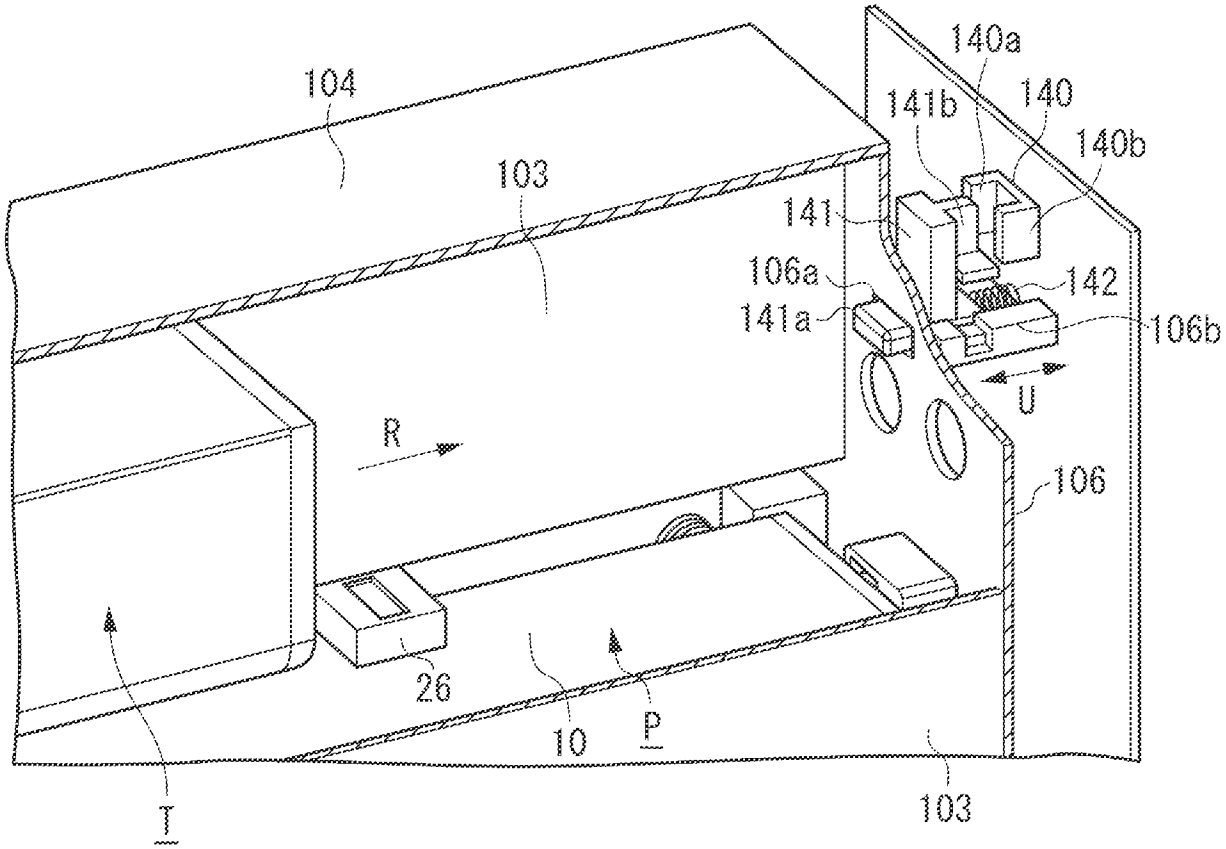
FIG. 8 is a detailed view of a developer replenishment cartridge attachment portion according to a first exemplary embodiment of the present invention.

FIG. 8 is a detailed view illustrating a rear side of the apparatus main body 100 of the developer replenishment cartridge attachment portion 102. As illustrated in FIG. 7, the process cartridge attachment portions 101 (101Y through 101K) and the developer replenishment cartridge attachment portions 102 (102Y through 102K) are divided from the adjacent cartridge attachment portions by side walls 103, upper walls 104, a rear wall 106 (See FIG. 8), etc. The cartridge attachment portions are independent of each other.

As illustrated in FIG. 8, a detection sensor 140 is provided on the outer side (the downstream side in the developer replenishment cartridge attachment direction) of the rear wall 106 (first partition member) on the rear side of the developer replenishment cartridge attachment portion 102. This detection sensor 140 is positioned on the upper side in the gravitational direction with respect to the developer replenishment opening 43 (the developer replenishment shutter 44) of the developer replenishment cartridge T (See FIG. 9).

The detection sensor 140 is equipped with a light emitting portion 140*a* and a light receiving portion 140*b*. The detection sensor 140 is configured to detect any shielding object between the light emitting portion 140*a* and the light receiving portion 140*b* when the light receiving portion receives no detection light.

On the other hand, there is provided a moving member 141 which extends from the inner side to the outer side of the developer replenishment cartridge attachment portion 102, passing through a connection hole 106*a* provided in the rear wall 106. The moving member 141 is provided with a shielding portion 141*b* (detected portion) described below and a pressed portion 141*a*. The shielding portion 141*b* extends toward the detection sensor 140, which is located above the connection hole 106*a*.

Further, the moving member 141 is supported by a moving member guide 106*b* provided on the rear wall 106 so as to be movable in a direction (indicated by the arrow U in the diagram) parallel to the attachment direction (indicated by the arrow R in the diagram) of the developer replenishment cartridge T. And, it is urged by a moving member spring 142 toward the upstream side in the developer replenishment cartridge T attachment direction (a direction opposite the direction of the arrow R in the diagram).

Figure 9A:
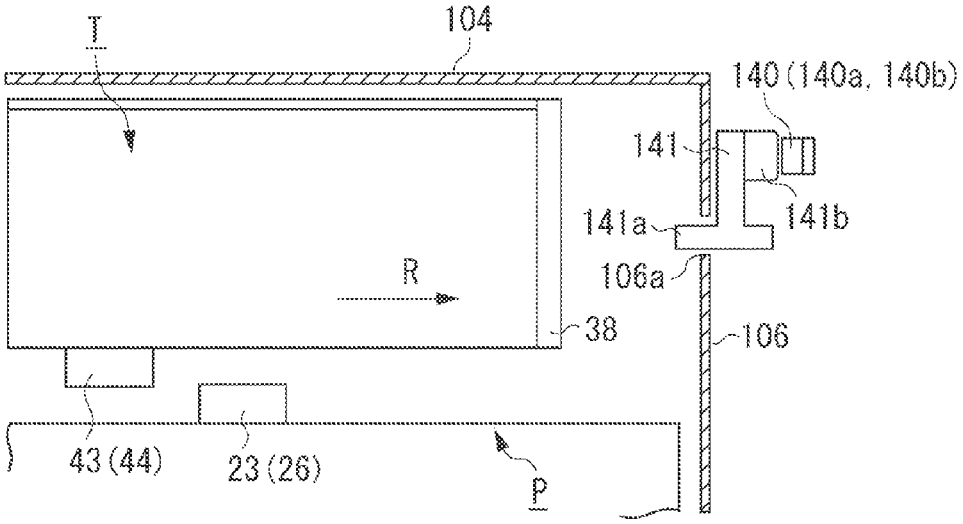
FIG. 9 is a diagram illustrating a developer replenishment cartridge attachment operation according to the first exemplary embodiment of the present invention.
Figure 9B:
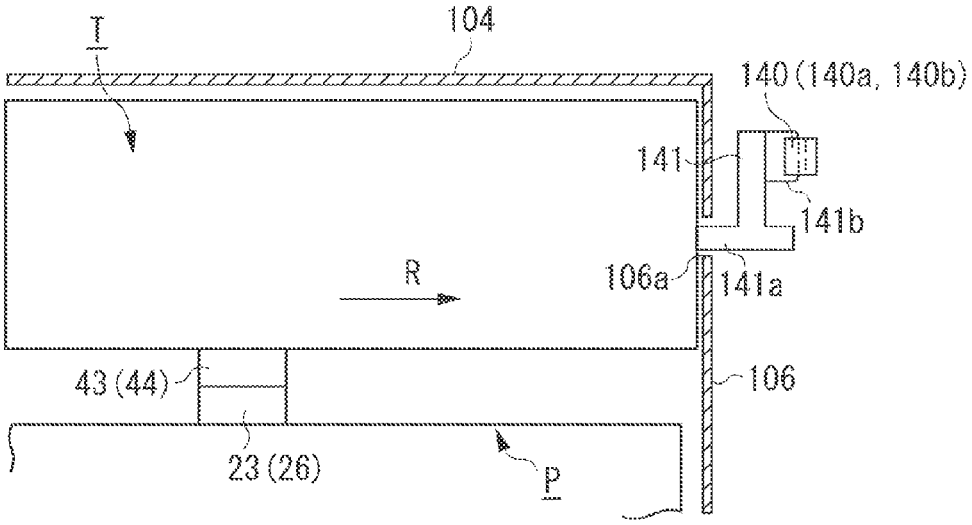

Next, the operation performed when attaching the developer replenishment cartridge T will be described with reference to FIGS. 9A and 9B. FIGS. 9A and 9B illustrate the operation of attaching the developer replenishment cartridge T. Of these diagrams, FIG. 9A illustrates the state before the completion of the attachment of the developer replenishment cartridge T, and FIG. 9B illustrates the state at the time of completion of the attachment of the developer replenishment cartridge T.

As illustrated in FIG. 9A, before the completion of the attachment of the developer replenishment cartridge T, the shielding portion 141*b* (detected portion) of the moving member 141 is retreated from between the light emitting portion 140*a* and the light receiving portion 140*b* of the detection sensor 140, and the detection sensor 140 does not detect the shielding portion. Accordingly, it detects that no developer replenishment cartridge has been attached yet.

On the other hand, as illustrated in FIG. 9B, when the developer replenishment cartridge T is attached to the developer replenishment cartridge attachment portion 102, a pressing portion 38 (See FIG. 9A) of the developer replenishment cartridge T is pressed against the pressed portion 141*a* of the moving member 141, and the moving member 141 moves to the downstream side in the attachment direction.

When the shielding portion 141*b* of the moving member 141 moves to a detection position (predetermined position) between the light emitting portion 140*a* and the light receiving portion 140*b* of the detection sensor 140, the detection sensor 140 detects the shielding object. Through the detection of the shielding object by the detection sensor 140, it is detected that the attachment of the developer replenishment cartridge T has been completed (i.e., the developer replenishment cartridge has been attached).

The system in which it is detected whether the developer replenishment cartridge T has been attached or not using the detection light, can involve the following problem.

Due to the airflow generated inside the developer replenishment cartridge attachment portion as a result of the attachment/detachment of the developer replenishment cartridge T, it can happen that the developer adhering to the surface of the developer replenishment cartridge, the walls forming the developer replenishment cartridge attachment portion, the upper surface of the process cartridge P, etc., may be scattered.

In particular, when the attachment/detachment of the developer replenishment cartridge T and of the process cartridge P is frequently repeated, or abnormality occurs such as the opening and closing of their shutters being impossible at the time of attachment/detachment, a large amount of developer may adhere to the surfaces of the developer replenishment shutter 44 and of the developer reception shutter 26.

When, in this state, the developer replenishment cartridge T is attached, the developer adhering to the surface of the shutter will be scattered in the developer replenishment cartridge attachment direction.

When the scattered developer adheres to the light emitting portion 140*a* and the light receiving portion 140*b* of the detection sensor 140, a reduction in a light emission amount and a light reception amount occurs, which may cause the detection sensor 140 to erroneously detect the shielding object.

In the present exemplary embodiment, the shielding portion 141*b* moves to the detection position above the pressed portion 141*a*, and it detected whether or not the developer replenishment cartridge T has been attached through detection light passing that position. Due to this configuration, as compared with the case where the shielding object is detected at the same height as the pressed portion 141*b*, the amount of scattered developer to reach the detection position is reduced, so that it is possible to suppress erroneous detection of the cartridge attachment state.

Further, in the configuration according to the present exemplary embodiment, the detection sensor 140 is provided on the downstream side of the developer replenishment cartridge attachment portion 102 in the developer replenishment cartridge T attachment direction (on the downstream side of the rear wall 106 in the developer replenishment cartridge T attachment direction). Further, the pressing portion 38 is partitioned from the pressed portion 141*a* and the shielding portion 141*b* by the rear wall 106.

Due to the above construction, it is possible to suppress movement of the scattered developer to the downstream side of the rear wall 106 in the replenishment cartridge T attachment direction, so that it is possible to reduce the adhesion of developer to the surface of the detection sensor 140. Thus, it is possible to suppress a reduction in light emission amount and in light reception amount due to adhesion of developer to the light receiving portion 140*b*, and to prevent the detection sensor 140 from erroneously detecting the shielding object. Therefore, it is possible to more reliably detect the attachment condition of the developer replenishment cartridge T.

Next, a second exemplary embodiment of the present invention will be described. In the present exemplary embodiment, the basic configuration of the development device, of the process cartridge, of the developer replenishment cartridge, and of the image forming apparatus is the same as that of the first exemplary embodiment. Accordingly, the components having functions and configurations the same as or equivalent to those of the first exemplary embodiment are indicated by the same reference numerals, and a detailed description thereof will not be given.

In the following, the configuration for detecting the attachment of the developer replenishment cartridge according to the present exemplary embodiment will be described in detail.

First, an attachment portion for the developer replenishment cartridge T2 with respect to the apparatus main body 100 will be described with reference to FIGS. 10, 11, and 12.

Figure 10:
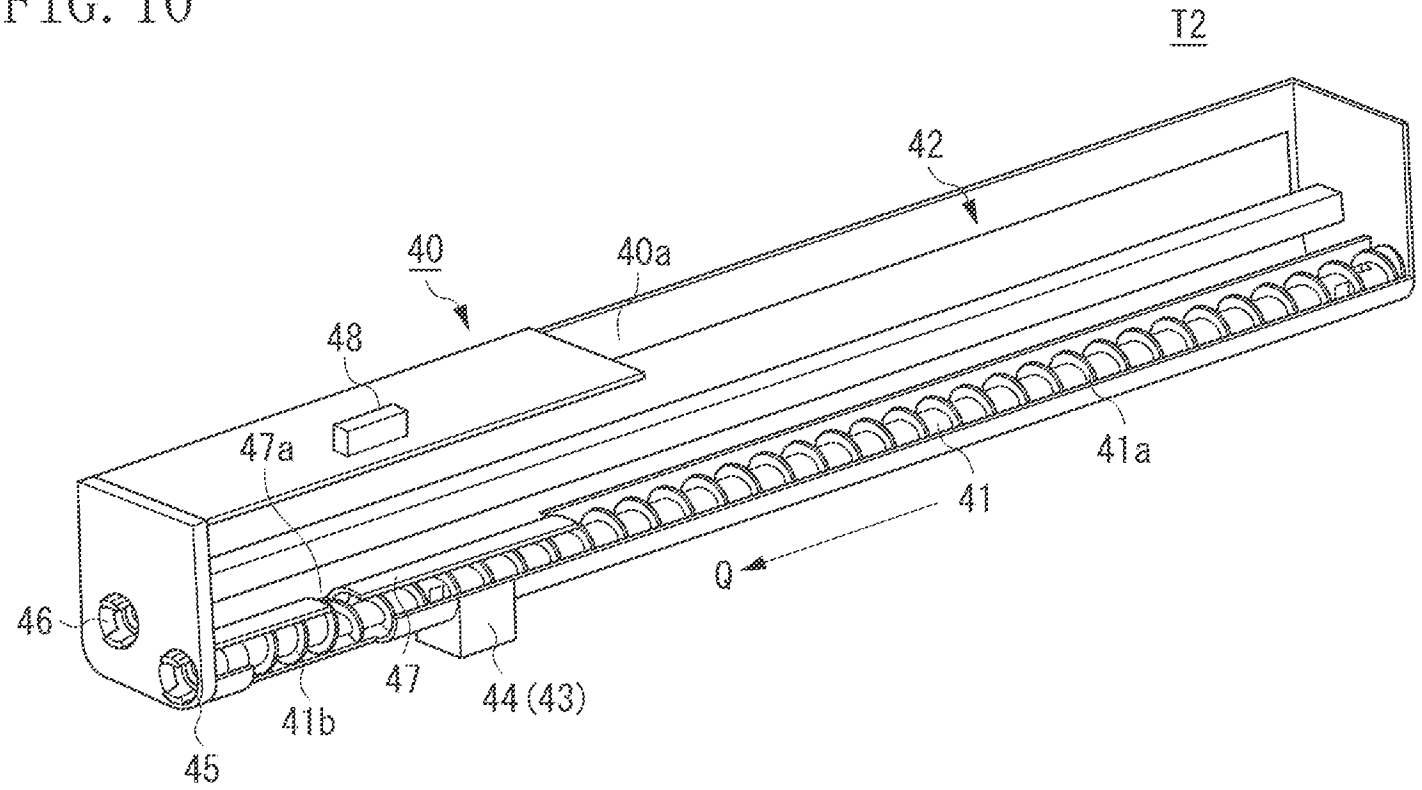
FIG. 10 is a perspective view illustrating a construction of a developer replenishment cartridge according to a second exemplary embodiment of the present invention.

FIG. 10 is an overall view of the developer replenishment cartridge T2 according to the present exemplary embodiment.

Figure 11:
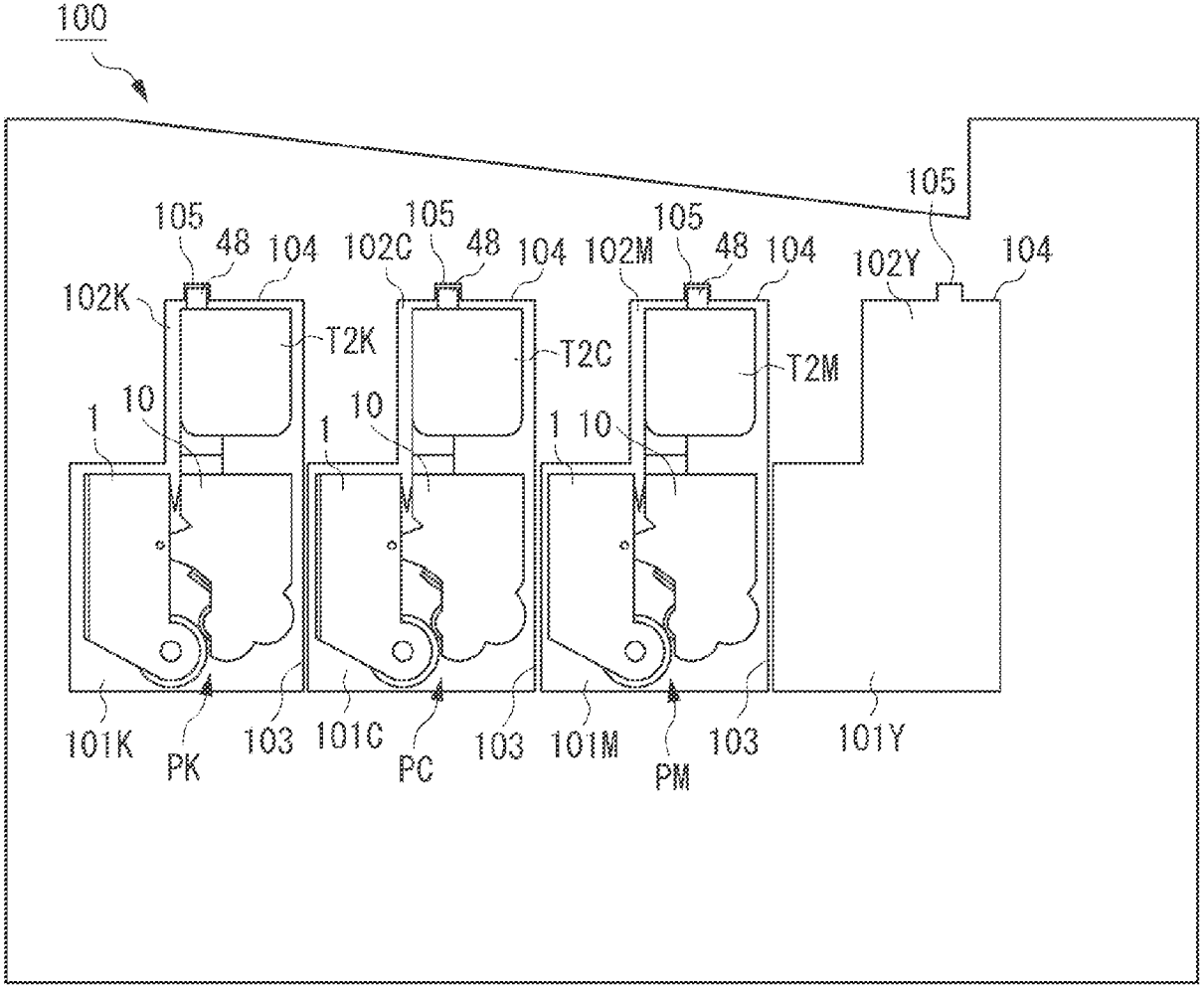
FIG. 11 is a front view of a process cartridge attachment portion and a developer replenishment cartridge attachment portion according to the second exemplary embodiment of the present invention.

FIG. 11 is a front view of the process cartridge attachment portion 101 and the developer replenishment cartridge attachment portion 102 of the apparatus main body 100.

Figure 12:
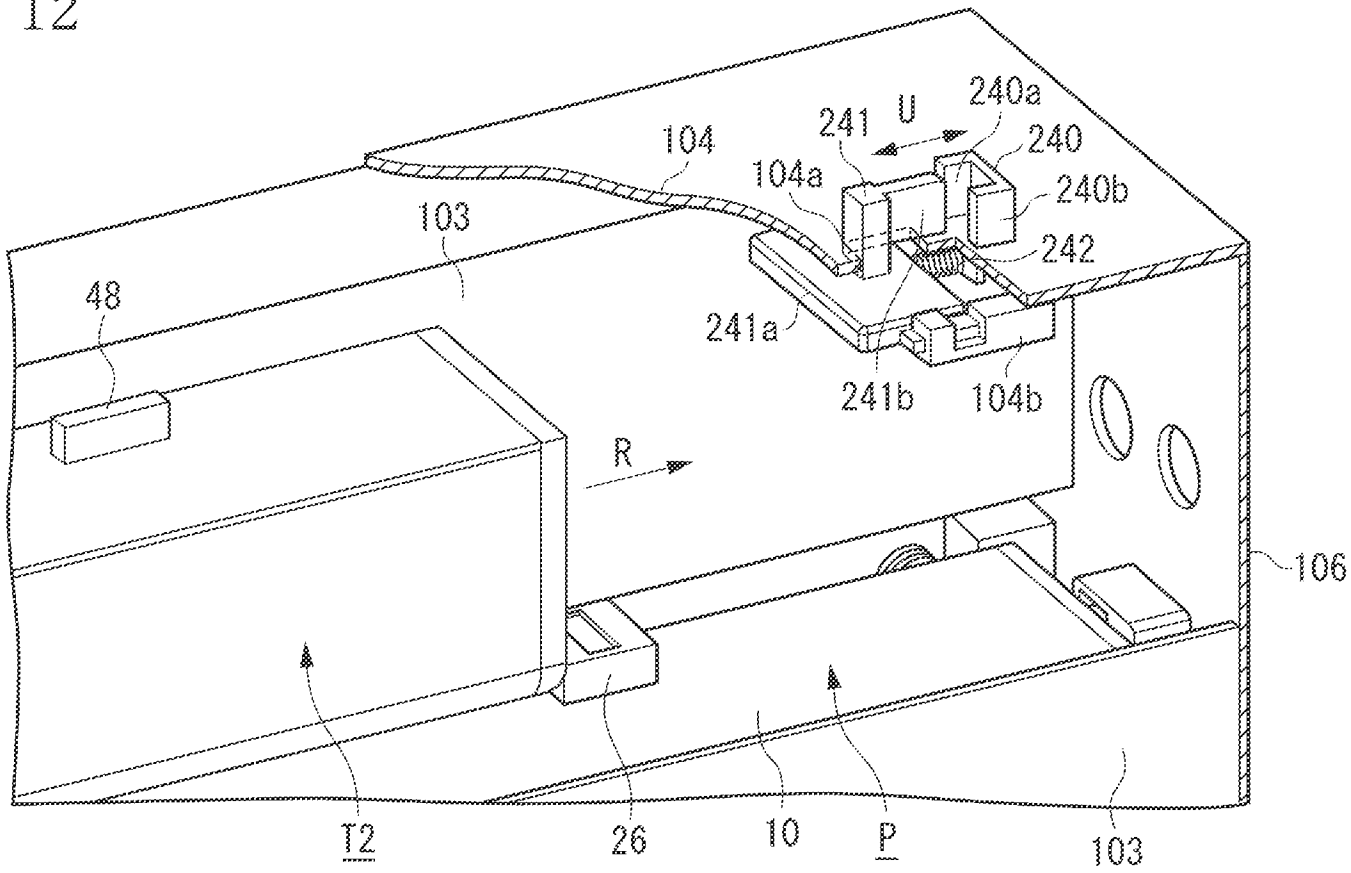
FIG. 12 is a detailed view of the developer replenishment cartridge attachment portion according to the second exemplary embodiment of the present invention.

FIG. 12 is a detailed view of the developer replenishment cartridge attachment portion 102 in the apparatus main body 100 rear side according to the present exemplary embodiment.

As illustrated in FIG. 10, on the upper portion of the developer replenishment cartridge T2, there is provided a pressing portion 48 for operating a moving member 241.

As illustrated in FIG. 11, on the front side of the developer replenishment cartridge attachment portion 102, there is provided an upstream groove 105 corresponding to the pressing portion 48 at the time of attachment of the developer replenishment cartridge T2.

When attaching the developer replenishment cartridge T2 to the developer replenishment cartridge attachment portion 102, the pressing portion 48 passes in the upstream groove 105. The pressing portion 48 can also be used as a member for identifying each developer replenishment cartridge 12 (T2Y, T2M, T2C, and T2K). In a state in which the developer replenishment cartridge T2 is attached to the image forming apparatus main body, an upper wall 104 is provided above the replenishment cartridge.

As illustrated in FIG. 12, a detection sensor 240 according to the present exemplary embodiment is provided further above the upper wall 104 (the second partition member). Further, there is provided a moving member 241 extending from the inner side toward the outer side of the developer replenishment cartridge attachment portion 102 through a connection hole 104*a* provided in the upper wall 104.

Like the moving member 141 according to the first exemplary embodiment, the moving member 241 is equipped with a shielding portion 241*b* and a pressed portion 241*a*. The pressed portion 241*a* and the pressing portion 48 are partitioned from the shielding portion 241*b* by the upper wall 104.

Further, the moving member 241 is supported by a moving member guide 104*b* provided on the upper wall 104 so as to be movable in a direction (indicated by the arrow U in the diagram) parallel to the developer replenishment cartridge T2 attachment direction (indicated by the arrow R in the diagram). And, the moving member 241 is urged by a moving member spring 242 toward the upstream side in the developer replenishment cartridge T2 attachment direction (in the direction opposite to the direction indicated by the arrow R in the diagram).

Next, the operation performed when attaching the developer replenishment cartridge T2 will be described with reference to FIGS. 13A and 13B.

Figure 13A:
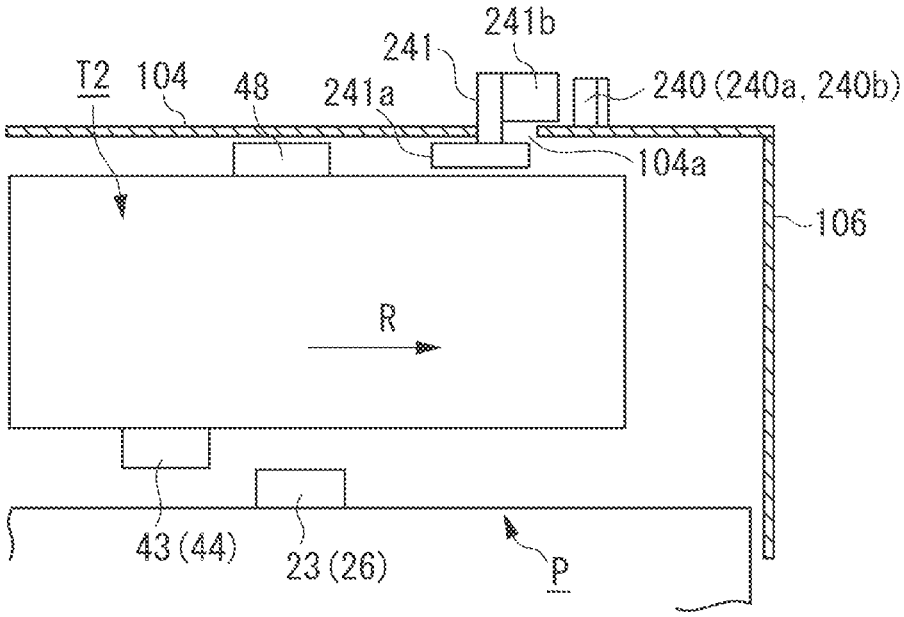
FIGS. 13A and 13B are diagrams illustrating a developer replenishment cartridge attachment operation according to the second exemplary embodiment of the present invention.
Figure 13B:
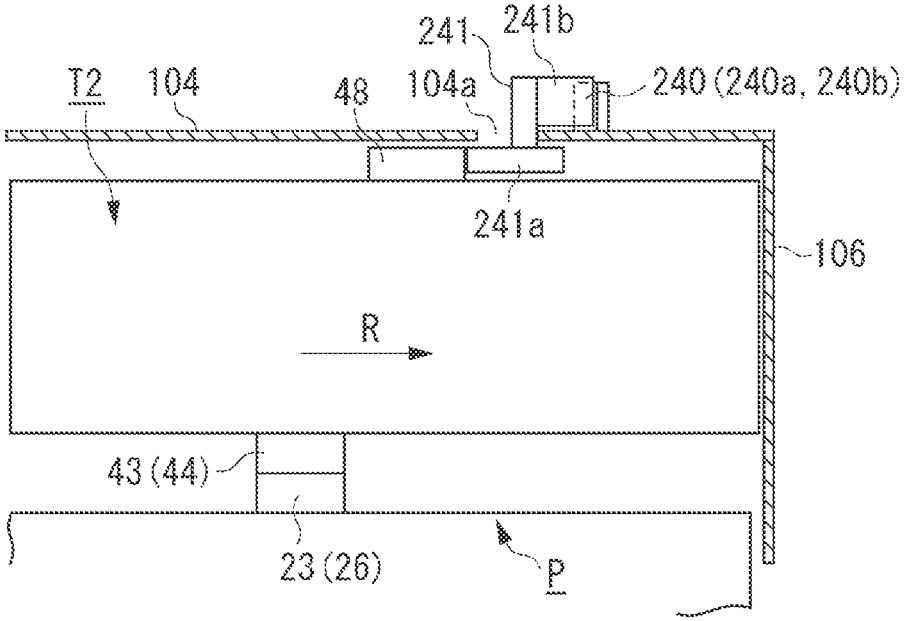

FIGS. 13A and 13B are diagrams illustrating the operation of attaching the developer replenishment cartridge T2. Of these diagrams, FIG. 13A illustrates the state before the completion of the attachment of the developer replenishment cartridge T2, and FIG. 13B illustrates the state at the time of completion of the developer replenishment cartridge T2.

As illustrated in FIG. 13A, before the completion of the attachment of the developer replenishment cartridge T2, the shielding portion 241*b* of the moving member 241 is retreated from between the light emitting portion 240*a* and the light receiving portion 240*b* of the detection sensor 240, which detects no shielding object.

On the other hand, as illustrated in FIG. 13B, when attaching the developer replenishment cartridge T2 to the developer replenishment cartridge attachment portion 102, the pressing portion 48 of the developer replenishment cartridge T2 is pressed against the pressed portion 241*a* of the moving member 241, and the moving member 241 moves to the downstream side in the attachment direction. Then, the shielding portion 241*b* of the moving member 241 enters the space between the light emitting portion 240*a* and the light receiving portion 240*b* of the detection sensor 240, and the detection sensor 240 detects the shielding object.

The determination by the detection sensor 240 as to whether or not the attachment of the developer replenishment cartridge T2 has been completed is similar to that in the first exemplary embodiment, so that a description thereof will be omitted.

In addition to the effects of the first exemplary embodiment, the present exemplary embodiment provides the following effects.

In the present exemplary embodiment, the detection sensor 240 is provided above the upper wall 104. As a result, it is possible to arrange the detection sensor 240 away from the developer replenishment opening 43. Further, the developer replenishment cartridge T2 and the upper wall 104 intercept the scattered developer, whereby it is possible to further reduce the amount of developer adhering to the surface of the detection sensor 240.

Thus, it is possible to suppress a reduction in light emission amount and light reception amount due to adhesion of developer to the light emitting portion 240*a* and the light receiving portion 240*b*, and to prevent erroneous detection of the shielding object by the detection sensor 240. As a result, it is possible to detect still more reliably the completion of the attachment of the developer replenishment cartridge T2.

While in the first and second exemplary embodiments the developer replenishment cartridge has the pressing portion 48, it is also possible for the process cartridge P to have the pressing portion, detecting whether or not the process cartridge P has been attached by using a moving member 241 and a detection sensor 240 similar to those of the first and second exemplary embodiments. In this way, it is possible to suppress erroneous detection of whether the process cartridge P has been attached or not.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-215335 filed Sep. 29, 2011, which is hereby incorporated by reference herein in its entirety.

What is claimed is:

1. An image forming apparatus comprising:

a development unit configured to develop an electrostatic image formed on an electrophotographic photosensitive member;

a cartridge, which is detachable from an image forming apparatus main body, configured to replenish the development unit with developer;

a moving member equipped with a pressed portion and a detected portion, in which the detected portion is configured to move to a predetermined position by the pressed portion being pressed by the cartridge when the cartridge is attached to the image forming apparatus main body;

a detection device configured to detect whether the cartridge is attached by detection light passing the predetermined position, and a partition member configured to partition the cartridge and the detected portion, wherein the moving member is provided so as to extend through a hole provided in the partition member.

2. The image forming apparatus according to claim 1, wherein the partition member is provided above the cartridge in a state in which the cartridge is attached to the image forming apparatus main body.

3. The image forming apparatus according to claim 1, wherein the partition member is provided on the downstream side of the cartridge in the cartridge attachment direction in a state in which the cartridge is attached to the image forming apparatus main body.

4. The image forming apparatus according to claim 1, wherein the detected portion is located above a replenishment opening provided in the cartridge in order to replenish the development unit with developer.

5. The image forming apparatus according to claim 1, wherein the shutter is positioned on a lower side in a gravitational direction with respect to the detected portion.

6. The image forming apparatus according to claim 1 further comprising a partition member configured to partition the pressed portion and the detected portion.

7. The image forming apparatus according to claim 1, wherein the cartridge has a shutter and the shutter is positioned on a lower side with respect to the detected portion.

8. A cartridge for replenishing a development unit that develops an electrostatic image formed on an electrophotographic photosensitive member with developer and detachable from an image forming apparatus main body, wherein the image forming apparatus main body includes:

a moving member equipped with a pressed portion and a detected portion, in which the detected portion is configured to move to a predetermined position by the pressed portion being pressed by the cartridge when the cartridge is attached to the image forming apparatus main body; and a detection device configured to detect whether the cartridge is attached by detection light passing the predetermined position, wherein the cartridge includes a pressing portion configured to move the detected portion to the predetermined position above the pressed portion by pressing of the pressed portion when the cartridge is attached to the image forming apparatus main body, wherein the moving member is provided so as to extend through a hole provided in a partition member.

9. The cartridge according to claim 8, wherein the pressing portion is partitioned from the detected portion by a partition member provided in the image forming apparatus main body in a state in which the cartridge is attached to the image forming apparatus main body.

10. The cartridge according to claim 8, wherein the pressing portion is partitioned from the detected portion by a partition member provided above the cartridge in a state in which the cartridge is attached to the image forming apparatus main body.

11. The cartridge according to claim 8, wherein the pressing portion is partitioned from the detected portion by a partition member provided on the downstream side of the cartridge in a cartridge attachment direction in a state in which the cartridge is attached to the image forming apparatus main body.

12. The cartridge according to claim 8, wherein the shutter is positioned on a lower side in a gravitational direction with respect to the detected portion.

13. The cartridge according to claim 8, wherein the cartridge has a shutter and the shutter is positioned on a lower side with respect to the detected portion.

14. An image forming apparatus comprising:

a cartridge, which is detachable from an image forming apparatus main body, configured to store developer used for image formation;

a moving member equipped with a pressed portion and a detected portion, in which the detected portion is configured to move to a predetermined position by the pressed portion being pressed by the cartridge when the cartridge is attached to the image forming apparatus main body;

a detection device configured to detect whether the cartridge is attached by detection light passing the predetermined position; and a partition member configured to partition the cartridge and the detected portion, wherein the moving member is provided so as to extend through a hole provided in the partition member.

15. The image forming apparatus according to claim 14, wherein the partition member is provided above the cartridge in a state in which the cartridge is attached to the image forming apparatus main body.

16. The image forming apparatus according to claim 14, wherein the partition member is provided on the downstream side of the cartridge in the cartridge attachment direction in a state in which the cartridge is attached to the image forming apparatus main body.

17. The image forming apparatus according to claim 14, wherein the cartridge further comprises an electrophotographic photosensitive member; and a developer carrying member configured to carry developer and to develop an electrostatic image formed on the electrophotographic photosensitive member.

18. The image forming apparatus according to claim 14, wherein the cartridge is a developer replenishment cartridge.

19. The image forming apparatus according to claim 14 further comprising a partition member configured to partition the pressed portion and the detected portion.

20. A cartridge, which is detachable from an image forming apparatus main body, configured to store developer, wherein the image forming apparatus main body includes:

a moving member equipped with a pressed portion and a detected portion, in which the detected portion is configured to move to a predetermined position by the pressed portion being pressed by the cartridge when the cartridge is attached to the image forming apparatus main body; and a detection device configured to detect whether the cartridge is attached by detection light passing the predetermined position and a partition member configured to partition the pressed portion and the detected portion, wherein the moving member is provided so as to extend through a hole provided in the partition member, and wherein the cartridge has a pressing portion configured to move the detected portion to the predetermined position above the pressed portion by pressing the pressed portion when the cartridge is attached to the image forming apparatus main body.

21. The cartridge according to claim 20, wherein the pressing portion is partitioned from the detected portion by a partition member provided above the cartridge in the state in which the cartridge is attached to the image forming apparatus main body.

22. The cartridge according to claim 20, wherein the pressing portion is partitioned from the detected portion by a partition member provided on the downstream side of the cartridge in a cartridge attachment direction in the state in which the cartridge is attached to the image forming apparatus main body.

23. The cartridge according to claim 20, further comprising:

an electrophotographic photosensitive member; and a developer carrying member configured to carry developer and to develop an electrostatic image formed on the electrophotographic photosensitive member.

24. The image forming apparatus according to claim 20, wherein the cartridge further comprises an electrophotographic photosensitive member; and a developer carrying member configured to carry developer and to develop an electrostatic image formed on the electrophotographic photosensitive member.

25. The image forming apparatus according to claim 20, wherein the cartridge is a developer replenishment cartridge.

26. The cartridge according to claim 20, wherein the cartridge has a shutter and the shutter is positioned on a lower side with respect to the detected portion.

* * * * *